United States Patent [19]

Fukuchi

[11] 4,345,636

[45] Aug. 24, 1982

[54] ROLLER SCREEN UNIT

[75] Inventor: Shigeki Fukuchi, Tokyo, Japan

[73] Assignee: Metako Kigyo Co., Ltd., Tokyo, Japan

[21] Appl. No.: 60,387

[22] Filed: Jul. 25, 1979

[30] Foreign Application Priority Data

Jul. 31, 1978 [JP] Japan ..... 53-93248

[51] Int. Cl.[3] ..... E06B 9/208

[52] U.S. Cl. ..... 160/297

[58] Field of Search ..... 160/297; 192/8 R; 185/37, 39

[56] References Cited

U.S. PATENT DOCUMENTS

| | | | |
|---|---|---|---|
| 953,842 | 4/1910 | Kaiserman | 160/297 |
| 1,352,410 | 9/1920 | Horton | 160/297 X |
| 1,395,297 | 11/1921 | Reardon | 160/297 |
| 3,521,694 | 7/1970 | Anderson | 160/323 R |
| 3,763,916 | 10/1973 | Gossling | 160/297 |
| 4,009,745 | 3/1977 | Erpenbeck | 160/297 |
| 4,250,942 | 2/1981 | Dreher et al. | 160/297 |

FOREIGN PATENT DOCUMENTS

| | | | |
|---|---|---|---|
| 265289 | 1/1965 | Australia | 160/297 |
| 2308777 | 11/1976 | France | 160/297 |
| 2000558 | 1/1979 | United Kingdom | 160/297 |

*Primary Examiner*—Rodney H. Bonck

[57] ABSTRACT

A roller screen unit including an outer sleeve, an intermediate sleeve loosely received in the outer sleeve, a core member loaded with an elongated spiral spring and received in the intermediate sleeve, a clutch mechanism connected to one end of the core member in association with the outer sleeve and a screen member wound around the outer roller sleeve is disclosed. The clutch mechanism includes a stator member and a rotator member turnably mounted on the stator member through one or more ball members to perform a function of the clutch on operation of the unit.

5 Claims, 5 Drawing Figures

ROLLER SCREEN UNIT

TECHNICAL FIELD OF THE INVENTION

This invention relates to a roller screen unit and more particularly to a roller screen unit with a clutch mechanism for drawing and winding various kinds of screens under the restoring function of a spring loaded in the roller unit.

BACKGROUND ART

In the conventional roller screen unit, the screen is drawn and rolled up in the winding means with the clutch mechanism usually arranged in an upper position of the window frame or in the ceiling. In order to perform an automatic winding operation a sleeve for rolling up the screen is loaded with a spiral spring which at its one end is fixed and connected at its opposite end to a pillow rotatable in accordance with the rolling operation of the roller so that a torsion power is accumulated in the spiral spring. The drawing operation of the screen or the discontinuation thereof may be performed in accordance with engagement or disengagement operation of the clutch mechanism.

According to the conventional clutch mechanism an engaging pawl when incorporated into the winding means is moved in the direction of its gravity or the vertical direction and also the power balls or rollers used in the clutch mechanism are moved only in the vertical direction as the screen is generally drawn or extended perpendicularly. Hence, when it is desired to draw or roll off the screen in the lateral direction the clutch mechanism is left in the engaged or disengaged position rendering the use of the screen unit impossible.

The latest diversity of life, however, requires the use of the screen unit in various directions and any convenient positions upon options of users. The clutch mechanisms heretofore proposed, however, could not fulfill such requirements.

Furthermore, in the conventional screen unit a rotary sleeve is turnably mounted on the fixed shaft which is interconnected with a terminal of the spiral spring and the rotary sleeve is connected to the roller sleeve. The bearing section of the fixed shaft against the rotary sleeve is relatively small for which reason undesired relaxation is caused to disturb the smooth turning operation of the roller sleeve.

SUMMARY OF THE INVENTION

It is, therefore, a general object of the invention to provide a roller screen unit with a clutch mechanism which may be used at any selected directions with constant and stable efficiency and thus enhancing an accuracy in operation.

In accordance with the invention there is provided a roller screen unit which comprises an outer roller sleeve, an intermediate sleeve received loosely in the outer roller sleeve, a core member loaded with an elongated spiral spring and received in the intermediate sleeve, a clutch mechanism connected to one end of the elongated spiral spring in association with the outer roller sleeve, a pillow member for the intermediate sleeve and connected with an opposite end of the elongated spiral spring in association with the outer roller sleeve and a screen member to be wound around the outer roller sleeve.

A clutch mechanism of the invention includes a stator member which at its one end is suspended by a bracket and at its opposite end is connected to one end of the elongated spiral spring member and a rotator member turnably mounted on the stator member through a ball clutch means.

The stator member comprises a cylindrical body which is provided at its one end with a cover disk with an abutting drum section in which one or more cavities are formed with an annular rim positioned in the boundary with the cylindrical body and at its opposite end with a channel with a pocket for receiving and engaging with one end of the elongated spiral spring.

The cylindrical body is further provided on its periphery with an elastically projected stopper means, at its one end with an extended shaft adapted to be inserted into one end of the core member and at its opposite end with a support member adapted to be suspended by the bracket. The cylindrical body and the support member may be formed integrally.

The rotator member comprises a sleeve body with a flanged end in which one or more chambers with contiguous recesses are formed for receiving the ball clutch means. The sleeve body at its periphery is provided with two or more longitudinally extended grooves for mesh with two or more ridges provided in an inner circumferential wall of the outer roller sleeve.

The pillow member comprises a cylindrical body having at its one end a toothed flange for mesh with the ridges of the outer roller sleeve and provided with a channel with a pocket for receiving and engaging with an end of the elongated spiral spring. The cylindrical body is further provided at its one end with an extended shaft adapted to be inserted into an opposite end of the core member.

Other objects and advantages of the invention will be more fully described with reference to the accompanying drawings illustrative of preferred embodiments of the invention in which:

PREFERRED EMBODIMENT OF THE INVENTION

Figure 1:
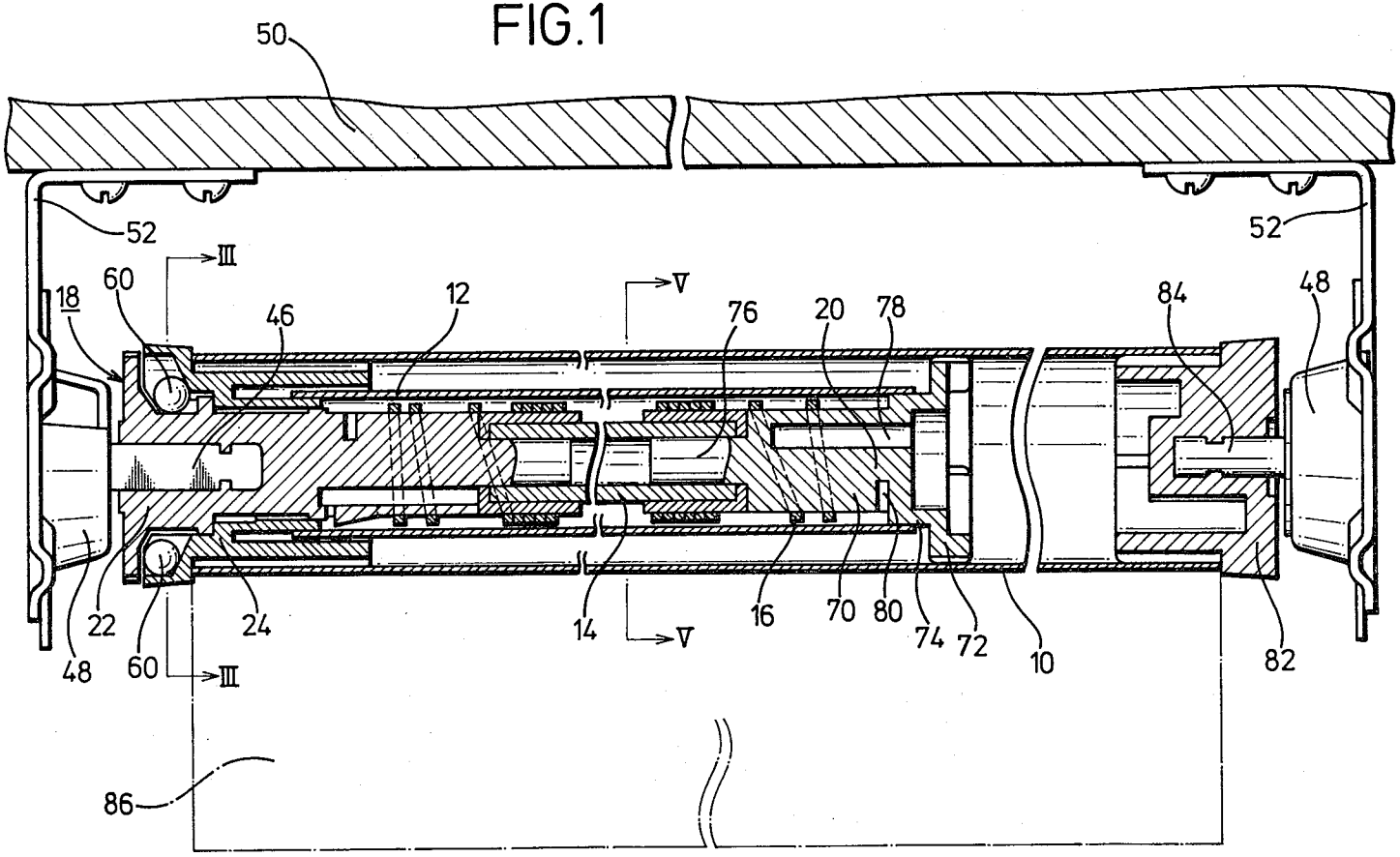
FIG. 1 is a longitudinally sectioned view of the roller screen unit secured to a convenient stationary frame in accordance with the invention.

In FIG. 1, the roller screen unit according to the invention is essentially comprised of a roller sleeve 10, an intermediate sleeve 12 loosely received in the roller sleeve 10 and a core member 14 received in the intermediate sleeve 12 through an elongated spiral spring 16 loaded on the core member 14.

The core member 14 is releasably connected at its one end to a clutch mechanism 18 and at its opposite end to a pillow member 20.

Figure 2:
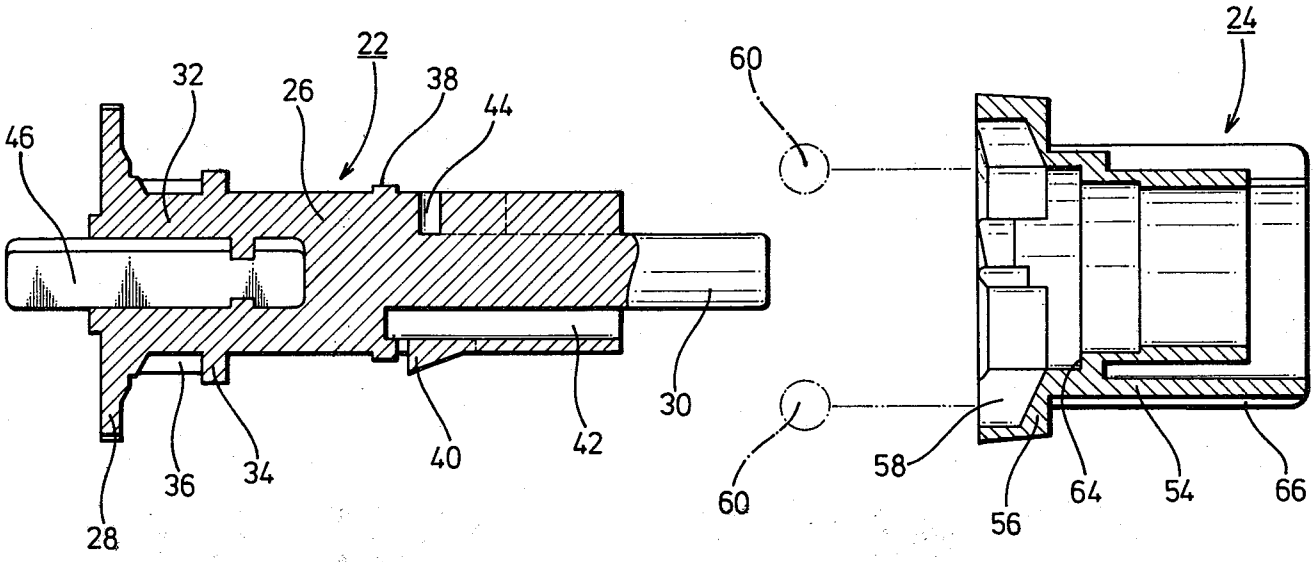
FIG. 2 is a sectional view of the clutch mechanism according to the invention.

As best shown in FIG. 2, the clutch mechanism 18 includes a stator member 22 and a rotator member 24 turnably mounted to the stator member 22.

The stator member 22 comprises a cylindrical body 26 which is provided at its one end with a cover disk 28 and at its opposite end with a shaft 30 having a smaller diameter than that of the cylindrical body 26 for insertion into an end of the core member 14. The cylindrical body 26 is further provided with a drum section 32 having an annular rim 34 spaced from the cover disk 28. In the periphery of the drum section 32 are formed two cavities 36, 36 extending between the cover disk 28 and the annular rim 34.

At the intermediate portion of the cylindrical body 26 is provided an annular ring 38 adjacent to which is provided an elastically projecting stopper 40 and a longitudinally extended groove 42 with a pocket 44 for receiving and engaging with a terminal of the spiral spring 16.

From outside of the cover disk 28 is inserted a metal support member 46 into the cylindrical body 26. Alternatively, the metal support member 46 and the cylindrical body 26 may be formed integrally. An extended end of the support member 46 is held by a bracket 48 which is suspended to a stationary frame 50 through an angle member 52 as shown in FIG. 1.

The rotator member 24 is comprised of a sleeve 54 having a flanged end 56. In the flanged end 56 are provided four chambers 58 for receiving balls 60 and at an entrance of the chamber 58 is provided in contiguous relation a recess 62 as clearly shown in FIG. 3. In abutment with the flanged end 56 there is provided an annular step 64 for receiving the rim 34 of the stator member 22 when the rotator member 24 is coupled with the stator member 22.

Figure 5:
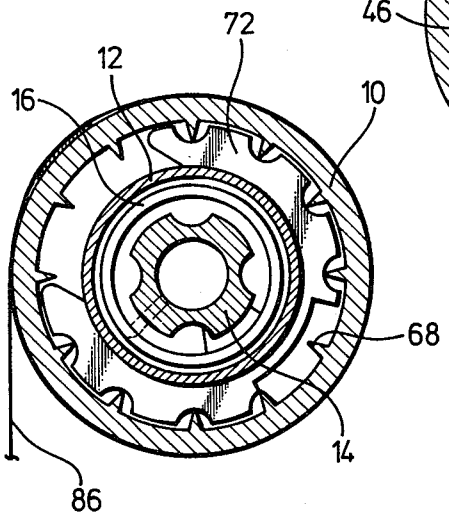
FIG. 5 is a cross-sectional view of the section taken along line V—V of FIG. 1.

In the circumference of the sleeve 54 are formed a number of longitudinally extending grooves 66 which are engaged with ridges 68 provided in an inner circumferential wall of the roller sleeve 10 as shown in FIG. 5.

In assembly of the clutch mechanism according to the invention, the stator member 22 is inserted into the rotator member 24 accomodating the balls 60 until the elastically projected stopper 40 is engaged with an open end of the rotator member 24.

Now coming back again to FIG. 1, the pillow member 20 is comprised of a cylindrical body 70 which is provided at its one end with a toothed flange 72 with a drum 74 in abutting relation and at its opposite end a shaft 76 having a smaller diameter than that of the cylindrical body 70 for insertion into the end of the core member 14. In the cylindrical body 70 is provided a longitudinally extended groove with a pocket 80 for receiving and engaging with an end of the spiral spring 16. The toothed flange 72 of the pillow member 20 is engaged with the ridges 68 of the roller sleeve 10 for transmitting the torsion power of the spiral spring 16 to the roller sleeve 10.

In assembling of the roller screen unit of the invention, the spring loaded core member 14 is inserted into the intermediate sleeve 12 and one end of the spring member 16 is engaged with the pocket 44 provided in the stator member 22 whereas the opposite end of the spring member 16 is engaged with the pocket 80 formed in the pillow member 20. Then, the intermediate sleeve 12 is inserted into the roller sleeve 10 so that one open end of the roller sleeve 10 is closed by the cover disk 28 of the stator member 22 with the flanged end 56 of the rotator member 24.

The opposite open end of the roller sleeve 10 is closed by a convenient end closure 82 having a support member 84.

The opposite extended ends of the support members 46 and 84 are held by the brackets 48, 48 arranged symmetrically. To the roller sleeve 10 is connected one end of a screen member 86. A side edge of the screen member 86 may be connected along its length to a convenient guide member (not shown) where the roller screen unit is installed perpendicularly.

Figure 3:
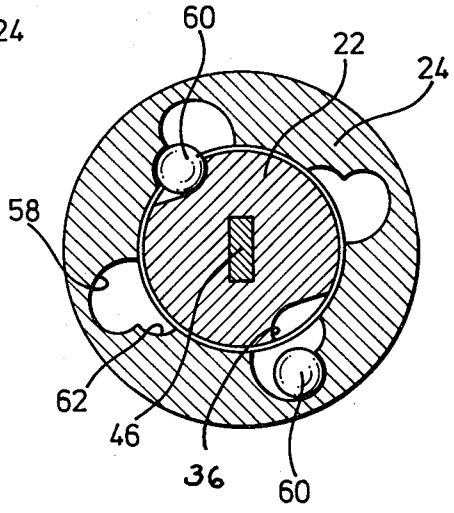
FIG. 3 is a cross-sectional view of the clutch mechanism taken along the line III—III of the FIG. 1.
Figure 4:
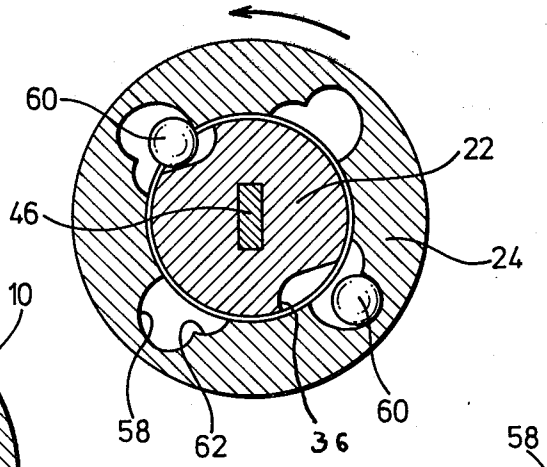
FIG. 4 is a cross-sectional view of the clutch mechanism similar to FIG. 3 but showing the free position of the clutch member.

The operation of the clutch mechanism 18 will be clearly appreciated from FIGS. 3 and 4. Namely, when the screen member 86 is drawn from the unit of the invention, the rotator member 24 turns counterclockwise against the stator member 22 entailing the balls 60, 60 around the circumference of the stator member 22 as shown in FIG. 4 while tightening the spiral spring 16 since the rotator member 24 is in engagement with the roller sleeve 10 which is also in engagement with the pillow member 20 to which one end of the spring 16 is connected thereby to accumulate an increased torsion power in the spring 16. When the drawing operation of the screen member 86 is discontinued, the rotator member 24 tends to turn clockwise against the stator member 22 under the restoring motion of the spring 16. When, however, the ball 60 rolled into the cavity 36 provided in the circumference of the stator member 22 and the recess 62 is fitted with a partial circumference of the ball 60, the turning of the rotator member 24 is disturbed under the function of the clutch so that the screen member 86 is held in the stretched position.

When the screen member 86 is intended to be rewound around the roller sleeve 10, the screen member is somewhat drawn to turn against the rotator member 24 counterclockwise thereby to release the ball 60 from its clutching position and immediately thereafter the screen member 86 is released from the drawing operation so that the rotator member 24 turns quickly around the stator member 22 without rendering the ball 60 to roll into the recess 62 and chamber 58 under the function of the accumulated torsion power of the spring 16. Thus, the screen member 86 is wound quickly around the roller sleeve 10.

As hereinbefore fully described, the roller screen unit according to the invention ensures a smooth drawing operation of the screen from the unit and a positive holding of the screen at any desired position even when the unit is used vertically, perpendicularly or diagonally.

Without further elaboration, the foregoing will so fully illustrate the invention that others may, by applying the current or future knowledge, readily adapt the same for use under various conditions of service.

What is claimed is:

1. A roller screen unit comprising an outer roller sleeve on which a screen member may be wound, an intermediate sleeve received loosely in said outer roller sleeve, a core member loaded with an elongated spiral spring and received in the intermediate sleeve, a clutch mechanism connected to one end of the elongated spiral spring in association with the outer roller sleeve, and a pillow member for the intermediate sleeve and connected with the opposite end of the elongated spiral spring, said clutch mechanism including a stator member comprising a cylindrical body having one end adapted to be suspended by a bracket and provided with a cover disk with an abutting drum section in which one or more cavities are formed said drum section having an annular rim spaced from said cover disk, and being further provided on its periphery spaced from said annular rim with an elastically projected stopper means, and at the opposite end with an extended shaft adapted to be inserted into one end of the core member and with a channel having a pocket for receiving and engaging with the one end of the elongated spiral spring, a rotator member rotatably mounted on the stator member comprising a sleeve body with a flanged end in which one or more chambers with contiguous recesses are formed, and balls received within said recess to form ball clutch means.

2. A roller screen unit as claimed in claim 1 including a support member for attachment to a bracket, integrally formed with said cylindrical body.

3. A roller screen unit as claimed in claim 1 wherein the sleeve body at its periphery is provided with two or more longitudinally extended grooves and the inner circumferential wall of the outer roller sleeve is provided with two or more ridges meshing with said grooves.

4. A roller screen unit as claimed in claim 1 wherein the pillow member comprises a cylindrical body having at its one end a toothed flange and the inner circumferential wall of the outer roller sleeve is provided with ridges meshing with the toothed flange.

5. A roller screen unit as claimed in claim 4, wherein the cylindrical body of the pillow member is further provided at its one end with an extended shaft adapted to be inserted into the core member.

* * * * *